US005415370A

United States Patent [19]

Valiulis

[11] Patent Number: 5,415,370

[45] Date of Patent: May 16, 1995

[54] HANGER ASSEMBLY WITH ORIENTING HOOK AND LABEL PLATE

[75] Inventor: Stanley C. Valiulis, Rockford, Ill.

[73] Assignee: Southern Imperial, Inc., Rockford, Ill.

[21] Appl. No.: 109,965

[22] Filed: Aug. 23, 1993

[51] Int. Cl.[6] ..... A47F 5/00

[52] U.S. Cl. ..... 248/220.4; 211/57.1; 211/59.1; 248/303

[58] Field of Search ..... 248/220.4, 222.2, 303, 248/304, 309.2; 211/57.1, 59.1, 106; 40/657, 659

[56] References Cited

U.S. PATENT DOCUMENTS

| | | | |
|---|---|---|---|
| 1,411,252 | 4/1922 | Bassett et al. | 211/59.1 X |
| 2,975,999 | 3/1961 | Bunch | 248/303 X |
| 3,189,185 | 6/1965 | Grasso | 211/59.1 |
| 3,220,682 | 11/1965 | Hannon | 248/303 X |
| 4,104,817 | 8/1978 | Herzog | 211/59.1 X |
| 4,182,505 | 1/1980 | Cobin | 248/220.4 |
| 4,497,464 | 2/1985 | Fast | 211/57.1 X |
| 4,546,943 | 10/1985 | Fast . | |
| 5,339,967 | 8/1994 | Valiulis | 248/220.4 X |

*Primary Examiner*—Alvin C. Chin-Shue
*Assistant Examiner*—Derek J. Berger
*Attorney, Agent, or Firm*—Leydig, Voit & Mayer, Ltd.

[57] ABSTRACT

A hanger assembly, used for displaying merchandise in front of a perforated horizontal shelf, includes an elongated arm having a mounting anchor for attaching to the shelf, a plate for holding a label, and a hook for suspending display merchandisers. The hook and the plate are oriented so that both the merchandiser and the label are clearly visible from a line of sight parallel to the shelf, thereby increasing the potential sales of the merchandise supported from the hanger.

9 Claims, 2 Drawing Sheets

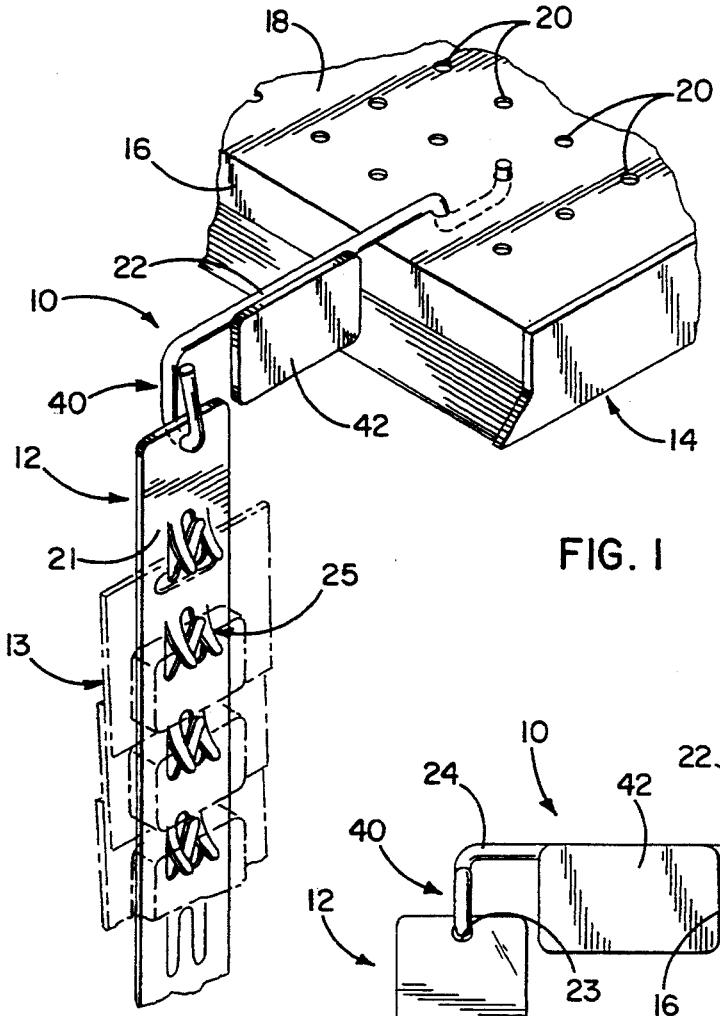
FIG. 1
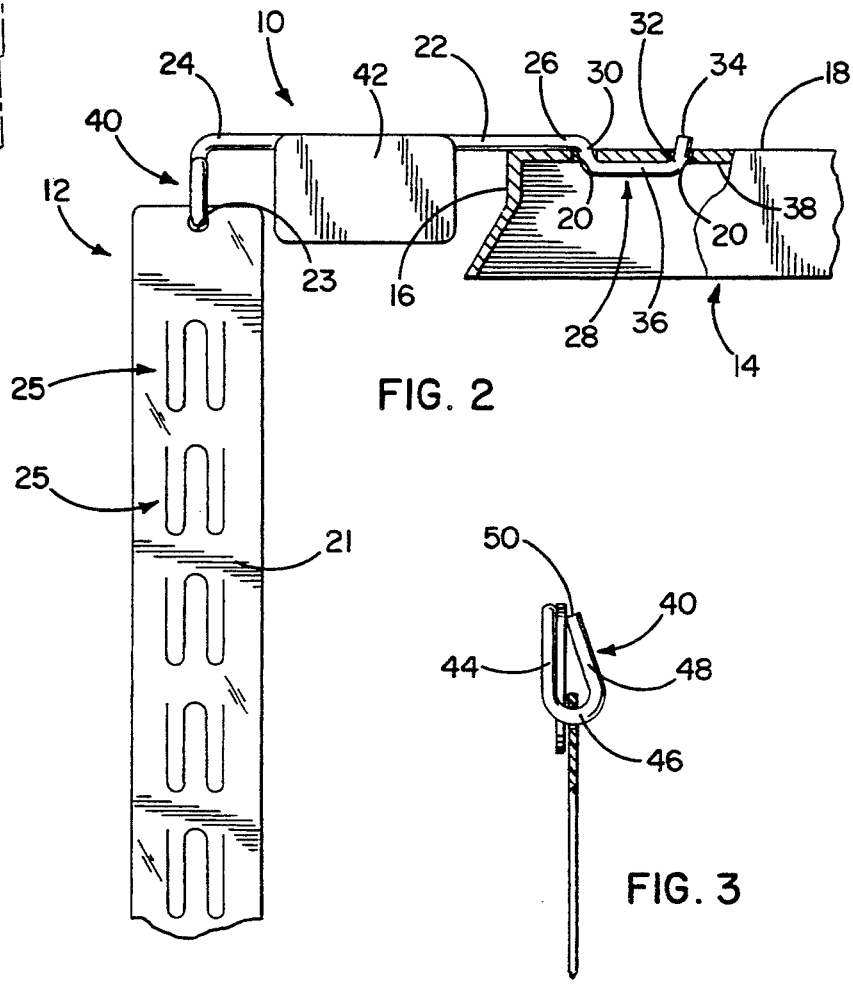
FIG. 2
FIG. 3

HANGER ASSEMBLY WITH ORIENTING HOOK AND LABEL PLATE

BACKGROUND OF THE INVENTION

This invention relates to a display hanger and, more particularly, to a hanger used to suspend merchandise from a horizontal shelf for viewing by store customers. Still more particularly, the hanger is adapted to hold a plastic strip merchandiser of the general type disclosed in Fast U.S. Pat. No. 4,546,943.

Most conventional methods of supporting plastic strip merchandisers orient the strip, merchandise attached thereto, and a corresponding label such that they face into the customer aisle provided between columns of shelves. As a result, the visibility of the merchandise is diminished because the flow of customer traffic is perpendicular to the direction in which the strip merchandisers are facing.

SUMMARY OF THE INVENTION

The general aim of the present invention is to provide a new and improved display hanger which vertically supports a plastic strip merchandiser so that both the merchandise and indicia label face the flow of customers as they pass through store aisles.

A more detailed objective of the invention is to achieve the foregoing by providing a display hanger which mounts to a shelf, and has a hook attached to, or integral with, an elongated arm. The hook projects downwardly from the arm a relatively short distance and then turns upwardly to terminate in an open end laterally spaced from the arm. The hook thereby enables merchandise to be placed on and suspended from the hanger such that it can be easily viewed from a direction parallel to the shelf.

The invention also resides a depending metal plate attached to the elongated arm. The metal plate faces laterally so that an indicia label affixed to the plate may be easily viewed by customers.

These and other objects and advantages of the invention will become more apparent from the following detailed description when taken in conjunction with the accompanying drawings.

BRIEF DESCRIPTION OF THE DRAWINGS

FIG. 1 is a fragmentary perspective view of a typical shelf equipped with one embodiment of a new and improved display hanger incorporating the features of the present invention.

FIG. 2 is a fragmentary side view of the shelf, the display hanger and the merchandiser, part of the shelf being broken away and shown in section.

FIG. 3 is a front view of the display hanger with part of suspended merchandiser being shown in section.

DETAILED DESCRIPTION OF THE PREFERRED EMBODIMENTS

Figure 4:
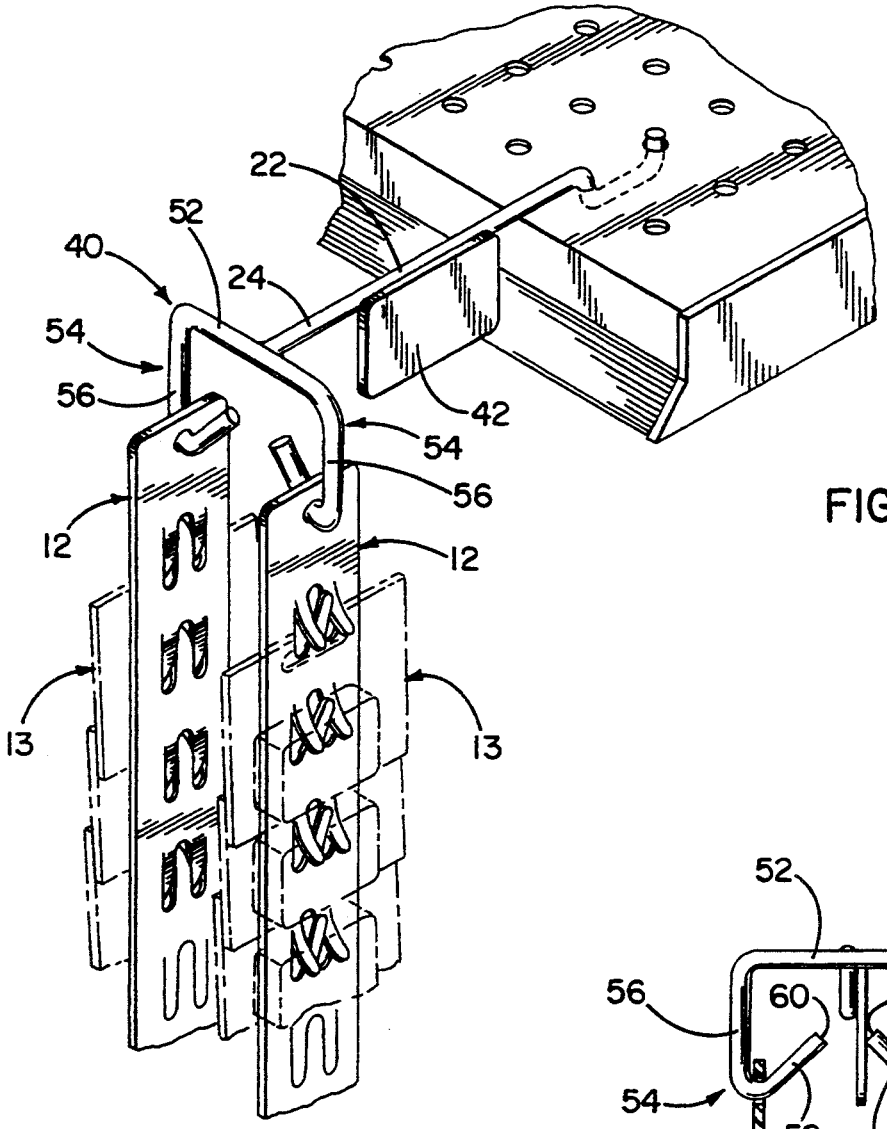
FIGS. 4 and 5 are similar to FIGS. 1 and 3, respectively, but show an alternative embodiment of the hanger.

For purposes of illustration, the invention has been shown in the drawings as incorporated in a display hanger 10 for supporting a strip merchandiser 12 which is particularly suited for displaying merchandise 13 in front of a horizontal shelf 14 having a front edge 16 and having a horizontal top surface 18 which is formed with several transversely extending rows of transversely spaced and vertically extending holes 20, the space between adjacent holes and adjacent rows typically being one inch.

The merchandiser is an elongated plastic strip 21 (FIG. 2) comprising an upper end portion containing a hole 23 for suspending the merchandiser from the hanger 10 and a plurality of integral means 25 spaced along the strip below the hole to releasably grip merchandise 13 so that customers can easily remove the merchandise for purchase. Reference may be made to the aforementioned Fast patent for a more detailed disclosure of merchandise holding means generally similar to the means 25.

The display hanger 10 consists of an elongated metal wire support arm 22 having first and second end portions 24, 26, respectively, the end portion 26 forming an integral means for mounting the arm in two of the vertically extending holes 20 in the shelf 14. The mounting means comprises a generally U-shaped anchor 28 including two end portions 30, 32. The anchor is contained within the same vertical plane as the arm 22. One end portion 30 is integral with the end portion 26 of the arm, while the other end portion 32 terminates in an upwardly facing free end 34. To attach the display hanger 10 to the shelf 14, the free end 34 of the anchor 28 is inserted downwardly through one of the vertically extending holes 20 located in proximity to the edge 16 of the shelf 14. The hanger is then maneuvered such that the free end of the anchor extends upwardly through the hole directly behind the first hole. The depth of the anchor 28 is such that the bottom portion 36 of the anchor engages the bottom side 38 of the shelf while a short section of the arm 22 extending forwardly from the first hole rests on the top surface 18 of the shelf. The hanger thus is securely but detachably connected to the shelf.

In accordance with the present invention, the support arm 22 extends forwardly from the shelf 14 and terminates in a support hook 40 (FIG. 3) which is oriented so as to suspend the strip merchandiser 12 parallel to the arm 22, thereby facing the flow of customers. Moreover, to provide customers and employees with a quick reference to merchandise information, a similarly facing plate 42 is attached to the arm such that a label (not shown) can be affixed thereto and viewed from the same direction as the merchandiser.

More particularly, the support hook 40 is generally U-shaped and is formed with a first portion 44 integral with and extending downwardly from the end portion 24 of the arm 22 in the plane thereof. A second portion of the hook 46 extends laterally from the lower end of the first portion. The hook terminates in an upwardly extending third portion 48 which is integral with and projects upwardly from the laterally extending portion 46. The third portion of the hook has an upper free end 50 spaced laterally from the first portion to enable the merchandiser 12 to be placed on and suspended from the hook 40. The hook is generally flat and is disposed within a vertical plane perpendicular to the arm 22.

The plate 42 preferably is flat and is made of sheet metal. The plate extends downwardly from the arm 22 with the upper portion of the plate preferably being welded to the arm. The plate is positioned on the arm between the end portion 26 of the arm and the support hook 40 so that a label attached to the plate 42 is visible between the shelf edge 16 and the merchandiser strip 12 disposed on the hook.

Figure 5:
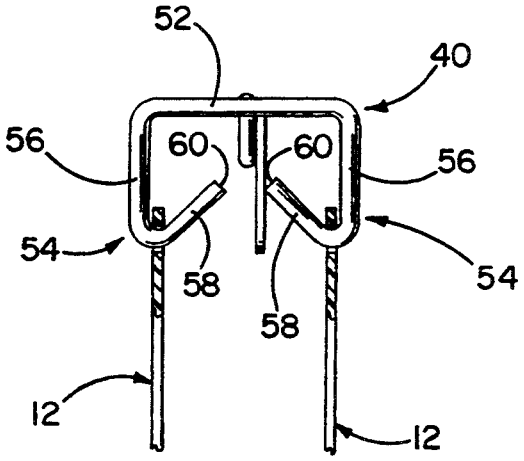

In an alternate embodiment (FIGS. 4 and 5), the hook 40 includes a crossrod 52 attached to the end portion 24 of the arm 22 and having two downwardly extending and oppositely facing generally J-shaped segments 54 at its two ends. The crossrod and the two J-shaped segments are contained within a vertical plane perpendicular to the arm 22.

The crossrod 52 is welded to the end 24 of the arm 22 and extends laterally from the arm an equal distance in both directions. Each J-shaped segment includes a leg 56 extending downwardly from the crossrod in the vertical plane thereof. An end portion 58 of each segment turns generally upwardly and inwardly from the leg 56 toward the crossrod, terminating in an upper free end 60 spaced laterally from the leg. The free ends of the segments enable two merchandisers 12 to be placed on and suspended from the hook 40 such that they face away from each other so that merchandise 13 can be viewed from either direction.

From the foregoing, it will be apparent that the present invention brings to the art a display hanger 10 with a support hook 40 which holds at least one plastic strip merchandiser 12, and a plate 42 to which labels are affixed, so that both the merchandise 13 and the label can easily be seen by customers as they progress down shopping aisles.

I claim:

1. A display hanger for suspending merchandise forwardlyof a generally horizontal display shelf having a plurality of vertically extending hole means formed therein, said hanger comprising a generally horizontal wire support arm disposed in a predetermined vertical plane, said arm having integral support means at one end thereof for retaining said hanger in said hole means, said support means being disposed substantially in said plane, a hook on the other end of said arm for suspending said merchandise, said hook having a downwardly extending portion and having an upwardly extending portion with an upper free end spaced laterally from the downwardly extending portion to enable merchandise to be placed on and suspended from said hook, and a substantially flat and laterally facing metal plate attached to and depending from said arm between said support means and said hook for holding an indicia label.

2. A display hanger as described in claim 1, in which said hook is integral with said arm and is generally U-shaped, said downwardly extending portion of said hook being located substantially in a said plane, said hook having a portion extending laterally from said downwardly extending portion, said upwardly extending portion of said hook projecting upwardly from said laterally extending portion.

3. A display hanger as described in claim 1, in which said hook includes a one-piece member having a crossrod and having two generally J-shaped segments facing toward each other for supporting merchandise, said crossrod being attached to said other end of said arm and extending perpendicular to and laterally of said arm, said J-shaped segments each having a leg extending downwardly from said crossrod, said segments each having an end portion which turns generally upwardly and inwardly from said leg and toward said crossrod, and each end portion having an upper free end spaced laterally from the respective leg.

4. A display hanger as described in claim 1, further including at least one elongated and generally vertical plastic strip having an upper end portion and having integral means spaced along said strip below said upper end portion for supporting said merchandise, and a hole formed through the upper end portion of said strip to enable said strip to be placed on said hook and oriented such that the strip faces laterally.

5. The combination of (A) a generally horizontal display shelf having a plurality of vertically extending hole means formed therein, and (B) a display hanger for suspending merchandise forwardly of said shelf, said hanger comprising a generally horizontal one-piece wire support arm, said arm having integral support means at one end thereof for retaining said hanger in said hole means, a generally U-shaped hook integral with the other end of said arm for suspending said merchandise, said hook having a first portion extending downwardly from said arm in the vertical plane thereof, having a second portion extending laterally from said first portion and having a third portion extending upwardly from said second portion, said third portion of said hook having an upper free end spaced laterally from the first portion of said hook to enable merchandise to be placed on and suspended from said hook, and a substantially flat and laterally facing metal plate attached to and depending from said arm between said support means and said hook for holding an indicia label.

6. The combination described in claim 5, further including an elongated and generally vertical plastic strip having an upper end portion and having integral means spaced along said strip below said upper end portion for supporting said merchandise, and a hole formed through the upper end portion of said strip to enable said strip to be placed on said hook and oriented such that the strip faces laterally in the same direction as said plate.

7. A display hanger for suspending merchandise forwardly of a generally horizontal display shelf having a plurality of vertically extending hole means formed therein, said hanger comprising a generally horizontal wire support arm, said arm having integral support means at one end thereof for retaining said hanger in said hole means, a hook on the other end of said arm for suspending said merchandise, said hook comprising a one-piece member having a crossrod and having two generally J-shaped segments facing toward each other for supporting merchandise, said crossrod being attached to said other end of said arm and extending perpendicular to and laterally of said arm, said J-shaped segments each having a leg extending downwardly from said crossrod in the vertical plane thereof, said segments each having an end portion which turns generally upwardly and inwardly from said leg and toward said crossrod, and each end portion having an upper free end spaced laterally from the respective leg.

8. A display hanger as described in claim 7, further including a pair of elongated and generally vertical plastic strips each having an upper end portion and each having integral means spaced along said strip below said upper end portion for supporting said merchandise, and a hole formed through the upper end portion of each strip to enable said strips to be placed on said J-shaped segments and oriented such that the strips face laterally.

9. The combination of (A) a generally horizontal display shelf having a plurality of vertically extending hole means formed therein, (B) at least one strip merchandiser, and (C) a hanger for suspending said merchandiser forwardly of said shelf, said strip merchandiser comprising an elongated and generally vertical plastic strip having an upper end portion with a hole, means formed integrally with and spaced along said strip for supporting items, said hanger comprising a generally horizontal support arm, said arm having integral support means at one end thereof for retaining said hanger in said hole means, a hook on the other end of said arm for suspending said merchandiser, said hook having a downwardly extending portion and having an upwardly extending portion with an upper free end spaced laterally from the downwardly extending portion to enable said merchandiser to be placed on and suspended from said hook such that said merchandiser is disposed in a vertical plane extending generally parallel to a vertical plane containing said arm.

* * * * *